US006475647B1

(12) United States Patent
Mendez Acevedo et al.

(10) Patent No.: US 6,475,647 B1
(45) Date of Patent: Nov. 5, 2002

(54) PROTECTIVE COATING SYSTEM FOR HIGH TEMPERATURE STAINLESS STEEL

(75) Inventors: Juan Manuel Mendez Acevedo; Chinnia Gounder Subramanian, both of Edmonton (CA)

(73) Assignee: Surface Engineered Products Corporation, Alberta (CA)

( * ) Notice: Subject to any disclaimer, the term of this patent is extended or adjusted under 35 U.S.C. 154(b) by 78 days.

(21) Appl. No.: 09/690,447

(22) Filed: Oct. 18, 2000

(51) Int. Cl.[7] ..... B32B 15/18; C23C 4/06

(52) U.S. Cl. ..... 428/678; 219/76.1; 219/76.12; 219/76.16; 427/405; 427/419.2; 427/456; 428/679; 428/685; 428/629; 428/652; 428/653; 428/938; 428/939; 428/941; 585/403; 585/920

(58) Field of Search ..... 428/678, 679, 428/685, 629, 652, 653, 472.2, 938, 939, 941; 427/456, 405, 419.2; 219/76.1, 76.12, 76.16; 585/403, 920

(56) References Cited

U.S. PATENT DOCUMENTS

| | | | | |
|---|---|---|---|---|
| 3,874,901 A | | 4/1975 | Rairden, III | 148/512 |
| 4,532,191 A | * | 7/1985 | Humphries et al. | 428/678 |
| 4,878,953 A | | 11/1989 | Saltzmann et al. | 427/405 |
| 5,403,629 A | | 4/1995 | Eichmann et al. | 427/404 |
| 5,624,717 A | | 4/1997 | Proner et al. | 427/455 |
| 5,958,332 A | | 9/1999 | Hoeg | 420/442 |

FOREIGN PATENT DOCUMENTS

EP 897996 A1 2/1999

OTHER PUBLICATIONS

U.S. patent application Ser. No. 09/589,196, Fisher et al., filed Jun. 8, 2000.

"Processing and Properties" entitled "The Effect of Time at Temperature on Silicon–Titanium Diffusion Coating on IN738 Base Alloy" by M.C. Meelu and M.H. Lorretto (No Date of Publication; No Journal Name).

P. Harris and B.L. Smith, Metal Construction 15 (1983) pp. 661–666, Nov. 1983.

G.A. Saltzman, P. Sahoo, Proc. IV National Thermal Spray Conference, 1991 pp. 541–548, May 1991.

* cited by examiner

*Primary Examiner*—Robert R. Koehler
(74) *Attorney, Agent, or Firm*—Arne I. Fors

(57) ABSTRACT

A method for protecting high temperature stainless steel from coking and corrosion at elevated temperatures in corrosive environments, such as during ethylene production by pyrolysis of hydrocarbons or the reduction of oxide ores, by coating the stainless steel with a coating of MCrAlX in which M is nickel, cobalt, iron or a mixture thereof and X is yttrium, hafnium, zirconium, lanthanum or combination thereof deposited onto and metallurgically bonded to the stainless steel by plasma transferred arc deposition of atomized powder of MCrAlX. The coating has a thick, dense, continuous and smooth transition region providing an effective metallurgically bond of the coating with the stainless steel. The coating retains a relatively high aluminum content which permits generation of an adherent alumina layer on the surface, providing good resistance to high temperature oxidation together with good anti-coking and hot erosion resistance properties.

21 Claims, 5 Drawing Sheets

Interface between NiCrAlY overlay and HTA alloy 900B

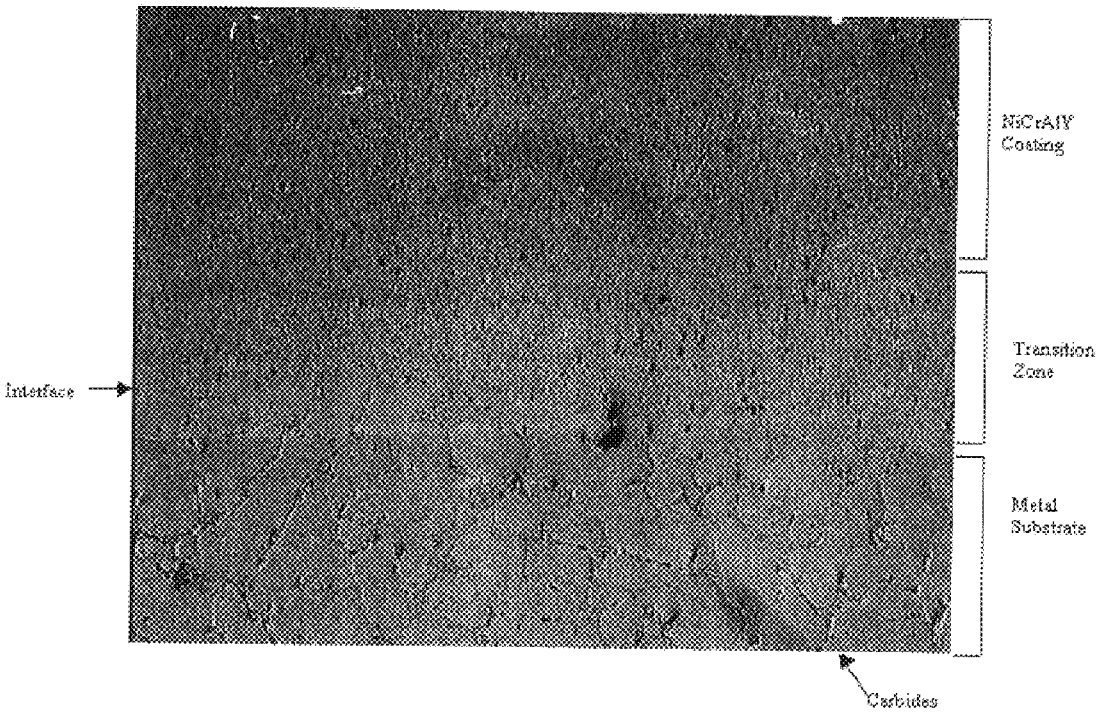
Figure 1: Interface between NiCrAlY overlay and HTA alloy 900B

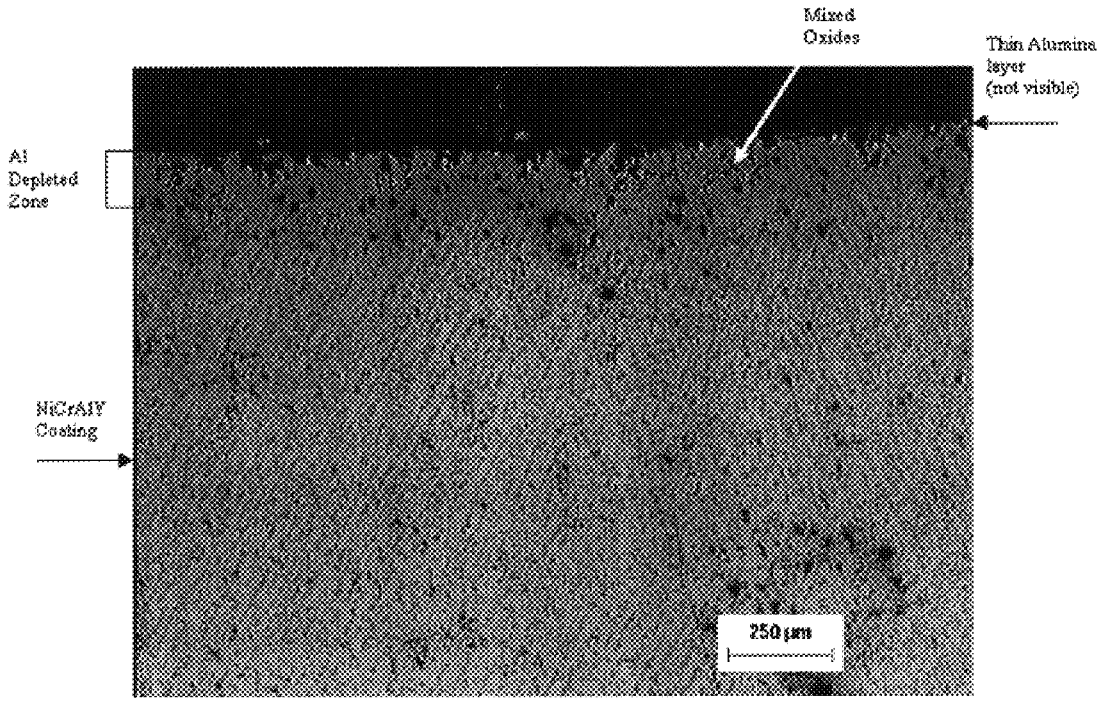
Figure 2: NiCrAlY top surface after 500 hours of aging in air at 1150 °C

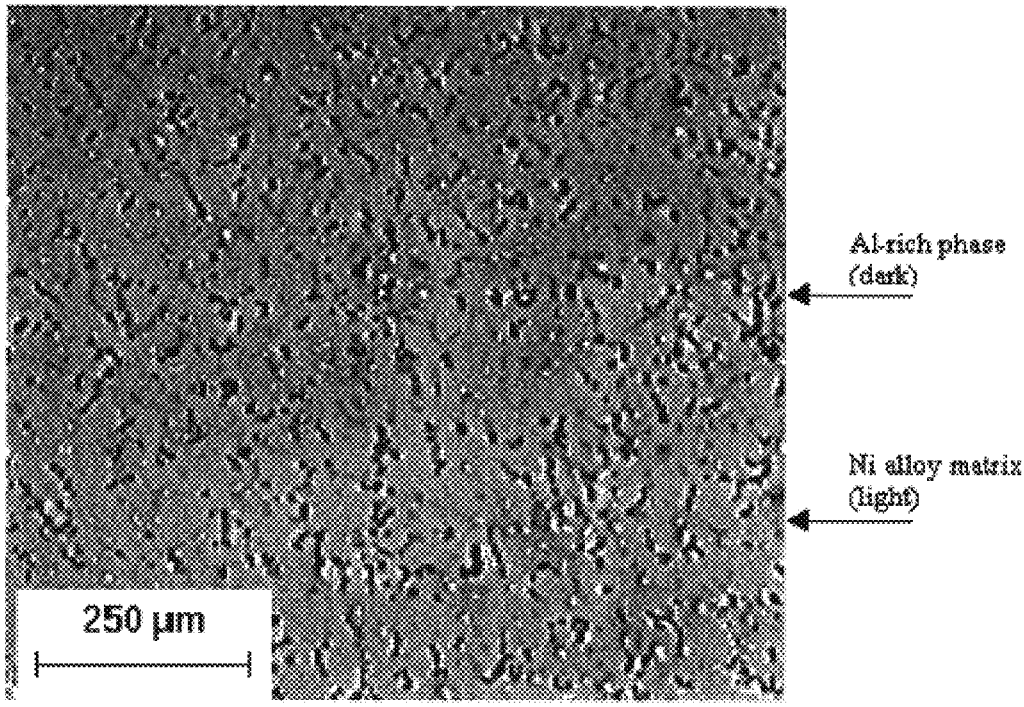
Figure 3: Bulk microstructure after 500 hours of aging in air at 1150 °C

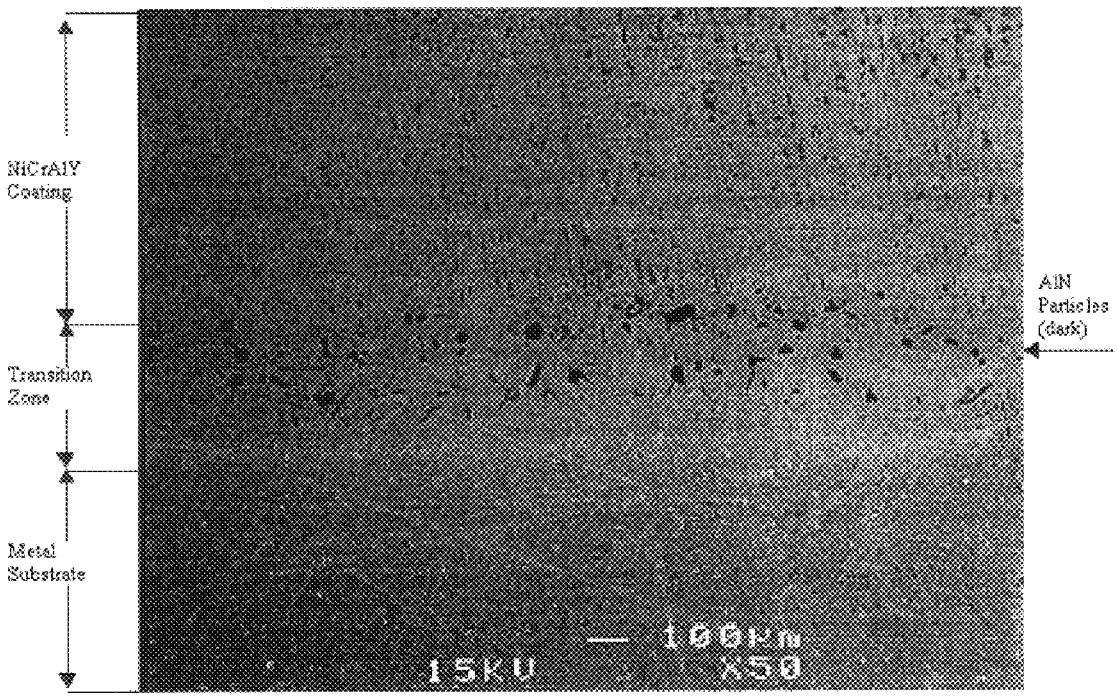
Figure 4: Interface between 900 B and NiCrAlY overlay after 500 hours aging in air at 1150 °C

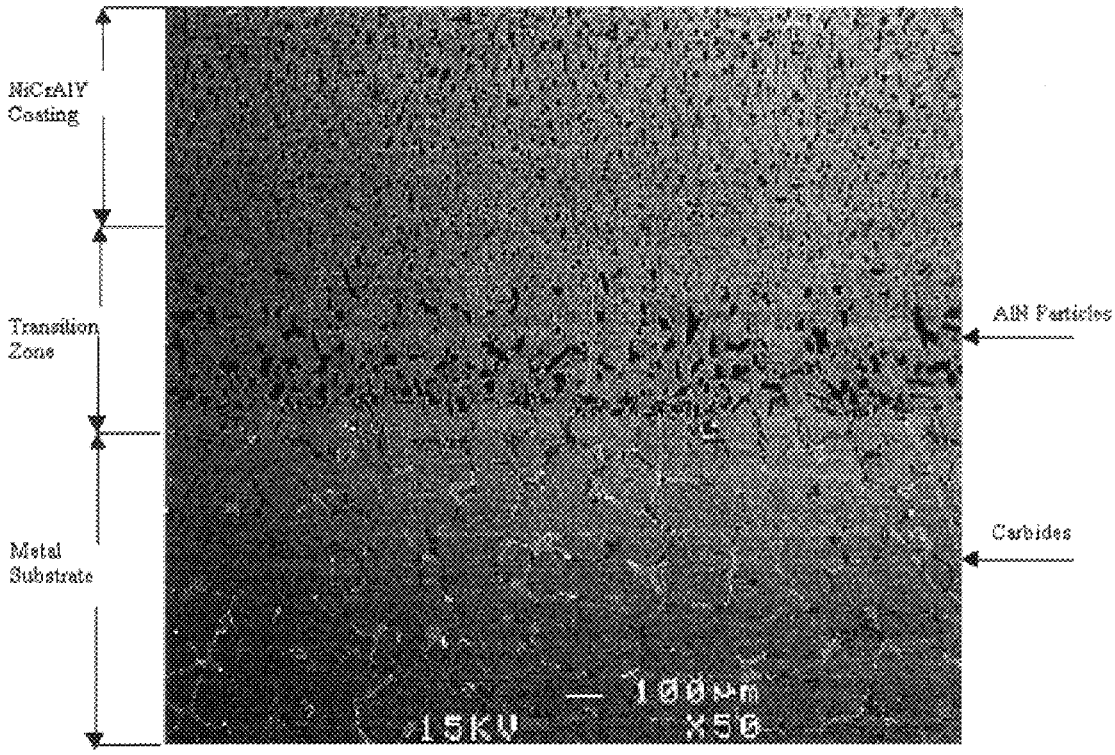
Figure 5: Interface between H45PM alloy and NiCrAlY

PROTECTIVE COATING SYSTEM FOR HIGH TEMPERATURE STAINLESS STEEL

BACKGROUND OF THE INVENTION

1. Field of the Invention

The present invention relates to a coating system for the generation of protective surface alloys for high temperature metal alloy products and, more particularly, relates to the provision of a metal alloy coating on the internal wall surfaces of high-temperature stainless steel tubes to produce a coating that provides corrosion resistance and reduces the formation of catalytic coking in hydrocarbon processing such as in olefin production and in direct reduction of ores.

2. Description of the Related Art

Stainless steels are a group of alloys based on iron, nickel and chromium as the major constituents, with additives that can include carbon, tungsten, niobium, titanium, molybdenum, manganese, and silicon to achieve specific structures and properties. The major types are known as martensitic, ferritic, duplex and austenitic steels. Austenitic stainless steel generally is used where both high strength and high corrosion resistance is required. One group of such steels is known collectively as high temperature alloys (HTAs) and is used in industrial processes that operate at elevated temperatures generally above 650° C. and extending to the temperature limits of ferrous metallurgy at about 1150° C. The major austenitic alloys used have a composition of iron, nickel or chromium in the range of 18 to 41 wt % chromium, 18 to 48 wt % nickel, balance iron and other alloying additives. Typically, high chromium stainless steels have about 31 to 38 wt % chromium and low chromium stainless steels have about 20 to 25 wt % chromium.

The bulk composition of HTAs is engineered towards physical properties such as creep resistance and strength, and chemical properties of the surface such as corrosion resistance. Corrosion takes many forms depending on the operating environment and includes carburization, oxidation and sulfidation. Protection of the bulk alloy is often provided by the surface being enriched in chromium oxide (chromia) and aluminum oxide (alumina).

These two metal oxides, or a mixture thereof, are mainly used to protect alloys at high temperatures. The compositions of stainless steels for high temperature use are tailored to provide a balance between good mechanical properties and good resistance to oxidation and corrosion. Alloy compositions which can provide an alumina scale are favoured when good high temperature oxidation resistance is required, whereas compositions capable of forming a chromia scale are selected for resistance to hot corrosive conditions. Unfortunately, the addition of high levels of aluminum to the bulk alloy is not compatible with retaining good mechanical properties. Therefore applying a coating containing aluminum onto the bulk alloy is a good way to provide the desired alumina surface oxide while maintaining desired mechanical properties.

One of the most severe industrial processes from a materials perspective is the manufacture of olefins such as ethylene by hydrocarbon steam pyrolysis (cracking). Hydrocarbon feedstock such as ethane, propane, butane or naphtha is mixed with steam and passed through a furnace coil made from welded tubes and fittings. The coil is heated on the outerwall and the heat is conducted to the innerwall surface leading to the pyrolysis of the hydrocarbon feed to produce the desired product mix at temperatures in the range of 850 to 1150° C. An undesirable side effect of the process is the buildup of coke (carbon) on the innerwall surface of the coil. There are two major types of coke: catalytic coke (or filamentous coke) that grows in long threads when promoted by a catalyst such as nickel or iron, and amorphous coke that forms in the gas phase and plated out from the gas stream. In light feedstock cracking, catalytic coke can account for 80 to 90% of the deposit and provides a large surface area for collecting amorphous coke.

The coke builds up and constricts flow in the tubes and acts as a thermal insulator, requiring a continuous increase in the tube outer wall temperature to maintain throughput. A point is reached when the coke buildup is so severe that either the pressure drop reaches unacceptable levels or the tube skin temperature cannot be raised any further and the furnace coil is then taken offline to remove the coke by burning it off (decoking). The decoking operation typically lasts for 24 to 96 hours and is necessary once every 10 to 180 days. During a decoke period, there is no marketable production which represents a major economic loss. Additionally, the decoke process degrades tubes at an accelerated rate, leading to a shortened lifetime. In addition to inefficiencies introduced to the operation, the formation of coke also leads to accelerated carburization, other forms of corrosion, and erosion of the tube inner wall. The carburization results from the diffusion of carbon into the steel forming brittle carbide phases. This process leads to volume expansion and the embrittlement results in loss of strength and possible crack initiation. With increasing carburization, the alloy's ability of providing some coking resistance through the formation of a chromium based scale deteriorates. At normal operating temperatures, half of the wall thickness of some steel tube alloys can be carburized in as little as two years of service. Typical tube lifetimes range from 3 to 6 years.

It has been demonstrated that aluminized steels, silica coated steels, and steel surfaces enriched in manganese oxides or chromium oxides are beneficial in reducing catalytic coke formation. Alonizing™, or aluminizing, involves the diffusion of aluminum into the alloy surface by pack cementation, a chemical vapour deposition technique. The coating is functional to form a NiAl type compound and provides an alumina scale which is effective in reducing catalytic coke formation and protecting from oxidation and other forms of corrosion. The coating is not stable at temperatures such as those used in ethylene furnaces, and also is brittle, exhibiting a tendency to spall or diffuse into the base alloy matrix. Generally, pack cementation is limited to the deposition of one or two elements, the co-deposition of multiple elements being extremely difficult. Commercially , it is generally limited to the deposition of only a few elements, mainly aluminum. Some work has been carried out on the codeposition of two elements, for example chromium and silicon. Another approach to the application of aluminum diffusion coatings to an alloy substrate is disclosed in U.S. Pat. No. 5,403,629 issued to P. Adam et al. This patent details a process for the vapour deposition of a metallic interlayer on the surface of a metal component, for example by sputtering. An aluminum diffusion coating is thereafter deposited on the interlayer.

Alternative diffusion coatings have also been explored. In an article in "Processing and Properties" entitled "The Effect of Time at Temperature on Silicon-Titanium Diffusion Coating on IN738 Base Alloy" by M. C. Meelu and M. H. Lorretto, there is disclosed the evaluation of a Si-Ti coating, which had been applied by pack cementation at high temperatures over prolonged time periods.

The benefits of aluminizing an MCrAlX coating on superalloys for improved oxidation and corrosion resistance have been previously well documented. European Patent EP 897996, for example, describes the improvement of high temperature oxidation resistance of an MCrAlY on a superalloy by the application of an aluminide top coat using chemical vapour deposition techniques. Similarly, U.S. Pat. No. 3,874,901 describes a coating system for superalloys including the deposition of an aluminum overlay onto an MCrAlY using electron beam-physical vapour deposition to improve the hot corrosion and oxidation resistance of the coating by both enriching the near-surface of the MCrAlY with aluminum and by sealing structural defects in the overlay. Both of these systems relate to improvement of oxidation and/or hot corrosion resistance imparted to superalloys by the deposition of an MCrAlY thereon. These references do not relate to improvement of anticoking properties or corrosion resistance of high temperature stainless steel alloys used in the petrochemical industries. Such stainless steels have different chemical compositions and have higher levels of elements considered to be impurities. Examples of impurities include embedded nitrogen and carbon which diffuse outward when the alloys are heated and can shorten the life of improperly designed surface coatings.

A major difficulty in seeking an effective coating is the propensity of many applied coatings to fail to adhere to the tube alloy substrate under the specified high temperature operating conditions in hydrocarbon pyrolysis furnaces. Additionally, the coatings lack the necessary resistance to any or all of thermal stability, thermal shock, hot erosion, carburization, oxidation and sulfidation. A commercially viable product for olefins manufacture by hydrocarbon steam pyrolysis and for direct reduction of iron ores must be capable of providing the necessary coking and carburization resistance over an extended operating life while exhibiting thermal stability, hot erosion resistance and thermal shock resistance. It must also be capable of maintaining adherence over time as the impurities of the stainless steels diffuse outward.

Plasma transferred arc surface (PTAS), as disclosed for example in U.S. Pat. Nos. 4,878,953 and 5,624,717, is a technique used to apply coatings of different compositions and thickness onto conducting substrates. The material is fed in powder or wire form to a torch that generates an arc between a cathode and the work-piece. The arc generates plasma that heats up both the powder or wire and surface of the substrate, melting them and creating a liquid puddle, which on solidification creates a welded coating. By varying the feed rate of material, the speed of the torch, its distance to the substrate and the current that flows through the arc, it is possible to control thickness, microstructure, density and other properties of the coating (P. Harris and B. L. Smith, Metal Construction 15 (1983) 661–666). The technique has been used in several fields to prevent high temperature corrosion, including surfacing MCrAlYs on top of nickel based superalloys (G. A. Saltzman, P. Sahoo, Proc. IV National Thermal Spray Conference, 1991, pp 541–548), as well as surfacing high-chromium nickel based coatings on exhaust valves and other parts of internal combustion engines cylinders (Danish Patent 165,125, U.S. Pat. No. 5,958,332). PTA has not been used in applying MCrAlX coatings on stainless steel for purposes such as providing anti-coking and anti-hot corrosion on the inside of stainless steel tube and fittings used in ethylene pyrolysis furnaces.

MCrAlX alloys, where M=nickel, cobalt or iron or mixture thereof and X=yttrium, hafnium, zirconium, lanthanum or combination thereto and more specifically MrCrAlY alloys were discovered to be useful as coatings for the high temperature stainless steel tubes used in the petrochemical industry. When tubes used in ethylene furnaces were coated with this material, an improvement on the anti-coking, anti-carburization and resistance to hot erosion properties of the tubes were observed. The most successful process by which these coatings are deposited onto HTA tubes needs several steps: production of cathodes by plasma spraying of the powders onto a metallic tube substrate, transfer from the cathode to the tube's inner surface by a sputtering process, and a heat treatment in the range of 1000 to 1160° C. as disclosed in co-pending U.S. application Ser. No. 90/589,196. These operational steps suffer the loss of the raw materials used as active agents; in almost every step part of the material is lost, either due to an inherent partial transfer of material or by less than 100% yield. For some alloys it may be necessary to deposit an interlayer between the HTA substrate and MCrAlX alloy coating and then heat treat. The interlayer will then scatter nitrides and carbides that may precipitate inside the coating to avoid forming of an undesirable continuous layer during long term exposure to high temperatures in service. A continuous nitride or carbide layer would jeopardize the mechanical integrity of the films by reducing their adhesion to the tube.

These NiCrAlY anti-coking coatings generally need a special heat treatment to cause diffusion between the coating and the HTA tube. This heat treatment also serves the purpose of densifying and stabilizing the coatings. However, the hear treatment is an extra step requiring control of temperature, heating rate and dwell time to successfully produce a high quality coating.

Summary of the Invention

It is therefore a principal object of the present invention to provide a surface alloy on HTAs by a single process step without heat treatment to substantially eliminate or reduce the catalytic formation of coke on the internal surfaces of tubing, piping, fittings and other ancillary furnace hardware and to increase the carburization resistance thereof during ethylene production by pyrolysis of hydrocarbons or the direct reduction of oxide ores.

It is another object of the invention to provide a tightly-adherent McrAlX coating on HTAs which provides a some of aluminum for a protective alumina scale with few structural defects, thereby eliminating the need for a separate aluminizing step.

It is a further object of the invention, to provide a direct transfer of alloy coating material in powder or wire loan to the substrate to significantly cabs the efficiency of transfer with savings in material costs while intimately metallurgically bonding the coating to the HTA substrate.

Another important object of the invention is the provision of a denser, continuous, smooth interface between the alloy coating and the substrate with dispersed precipitated nitrides and carbides to obviate the need for a separate interlayer.

In its broad aspect, the method of the invention for providing a protective and inert coating to high temperature stainless steels comprises providing a protective and inert coating on high temperature stainless steel comprising metallurgically bonding a continuous coating of a MCrAlX alloy, where M=nickel, cobalt or iron or mixture thereof and X=yttrium, hafnium, zirconium, lanthanum or combination thereof, having about 10 to 40 wt % chromium, preferably about 10 to 25 wt % chromium, about 3 to 30 wt % aluminum, preferably about 4 to 20 wt % aluminum, and up to about 5 wt % X, preferably up to about 3 wt % X more preferably 0.25 to 1.5 wt % X, the balance M, by plasma transferred arc deposition of the coating onto a high temperature stainless steel substrate. The coating is deposited in a thickness of about 20 $\mu$m to 6000 $\mu$m, preferably 50 to 2000 $\mu$m, more preferably 80 to 500 $\mu$m onto the substrate.

The MCrAlX preferably is NiCrAlY and has, by weight about 12 to 25% chromium, about 4 to 15% aluminum and about 0.5 to 1.5% yttrium, the balance nickel.

In accordance with this preferred embodiment of the invention, the deposition of a dense, anti-coking NiCrAlY alloy coating art a single step on a HTA tube by plasma transferred arc deposition produces a gradual metallurgical bond between the alloy coating and substrate. The desired final thickness of the coating is between about 0.02 and 6 mm thick. The preferred thickness is in the range of 80 to 500 $\mu$m in order to keep powder costs reasonable and to not unduly decrease the inner diameter of the tube.

The NiCrAlY alloy coating provides a source of aluminum to provide an =alumina based layer at the surface thereof by introducing an oxygen-containing gas such as air at a temperature above about 1000° C. upon heating of the substrate and coating in a gaseous, oxidizing atmosphere such as air at a temperature above 1000° C. in a separate step, or during commercial use by the introduction of or presence of an oxygen-containing gas at operating temperatures above about 1000° C. The more complete the alumina scale the better the anticoking and anti-corrosion performance. Enhanced properties can be therefore sometimes be achieved by a further aluminizing step.

In accordance with another embodiment of the invention, however, the high temperature stainless steel substrate having a continuous coating of said MCrAlX alloy with a thickness of about 50 to 2000 $\mu$m, preferably about 80 to 500 $\mu$m, may be aluminized by depositing a layer of aluminum on the coating in a thickness up to about 50% of the coating thickness, preferably about 20% of the coating thickness, such as by thermal spray or magnetron sputtering physical vapour deposition. The system can be heated in an oxygen-containing atmosphere in a consecutive step or in a separate later step for a time effective to form a surface layer of =alumina thereon. Heat treating the coating with aluminum thereon and the substrate diffuses aluminum into the coating.

DESCRIPTION OF THE DRAWINGS

FIG. 1 is a photomicrograph of an interface between NiCrAlY overlay coating deposited on a HTA alloy 900B;

FIG. 2 is a photomicrogaph of a NiCrAlY top surface after 500 hours of aging in air at 1150° C.

FIG. 3 is a photomicrograph of a bulk microstructure after 500 hours of aging in air at 1150° C.; and FIG. 4 is a photomicrograph of an interface between NiCrAlY overlay coating and a low chromium stainless steel after 500 hours aging in air at 1150° C.

FIG. 5 is a photomicrograph of an interface between NiCrAlY overlay coating and a high chromium stainless steel after 500 hours aging in air at 1150° C.

DESCRIPTION OF THE PREFERRED EMBODIMENT

A continuous overlay coating of MCrAlX is deposited onto and metallurgically and adherently bonded to a substrate of a high temperature austenite stainless steel by a plasma transferred arc process. The MCrAlX alloy of the invention in which M is a metal selected from the group consisting of iron, nickel and cobalt or mixture thereof and X is an element selected from the group consisting of yttrium, hafnium zirconium and lanthanum or combination thereof comprises, by weight, about 10 to 40% chromium preferably about 10 to 25%, about 3 to 30%, preferably about 4 to 20%, aluminum, and up to about 5%, preferably about 0.5 to 1.5%, yttrium, hafnium zirconium and/or lanthanum, the balance iron, nickel or cobalt. The high temperature stainless steel substrate has a composition of iron, nickel or chromium in the range, by weight, of 18 to 42% chromium, 18 to 48% nickel, the balance iron and other alloying additives, and typically is a high chromium stainless steel having about 31 to 38% chromium or a low chromium stainless steel having about 20 to 25% chromium.

The substrates to which the MCrAlX overlay coating is applied typically are high chromium or low chromium stainless steel centrifugally cast or wrought tubes or fittings such as used in an ethylene furnace and the coating is applied to the inside surface of such products. It has been found that application of to coating by plasma transferred arc process deposition permits application of a continuous, uniformly thick and dense overlay coating throughout the length of the inside surfaces of the tubes and the fittings.

A preferred MCrAlX is NiCrAlY which comprises, by weight, about 12 to 25% chromium, about 4 to 15% aluminium, about 0.5 to 1.5% yttrium, and the balance substantially nickel.

The deposition process for the NiCrAlY coating involves the application of a powder raw material with a typical composition range of Cr 10 to 40 wt %, Al 3 to 30 wt %, Y up to 5 wt% with different mixtures of Ni, Co, Fe comprising the balance, by a plasma transferred arc process with the base alloy forming put of the electric circuit. In the said process a plasma arc melts both the powder and the alloy; argon being used as a carrier and shrouding gas to prevent oxidation. The process parameters are controlled during deposition to yield a melt puddle that will yield a coating with a desired thickness. By melting put of the substrate alloy, some dilution occurs which affects the final composition of the coating. It the produces a desired transition zone between the alloy and the coating, which accommodates, in a scattered fashion, the carbides and nitrides formed due to the diffusion of carbon and nitrogen at the high temperatures at which ethylene furnaces operate. This significantly reduces the risk of spallation of the coatings.

The coating thus produced is dense, forms an alumina scale when exposed to air at high temperatures, and is tightly adhered to tube. The plasma transferred arc process can eliminate a separate aluminizing step. Also, the material transfer method is highly efficient and between 80 to 90% of the raw material is incorporated into the coating, compared to between 25 and 30% with the method as described in patent pending 09/599,196.

The process of the invention will now be described with reference to the following non-limiting examples.

EXAMPLE 1

Two high temperature alloy stainless steel materials were used as substrates; one a H46M alloy the other one 900 B alloy. The coating was obtained from a NiCrAlY powder with a nominal composition in weight percentage of Al 10, Cr 22, Yl, Ni balance, with impurities comprising less than 1 wt %. The size distribution of the powder was as +45 microns−106 microns. It was fed to the gun at a rate of 30 grams per minute using 100 amps and 50 volts across the arc.

The coating was dense to continuous, over 4 mm thick, with a smooth interface as shown in FIG. 1. No defects spanning from the base alloy to the coating surface were observed but some bubbles could be detected near the outer surface of the coaling. The composition reflected the fact that part of the alloy was melted, so the NiCrAlY got mixed and diluted with the elements present in the HTA. In both cases the aluminum content was between 5 to 7 wt %. The sample deposited on H46M had however less iron, more nickel and chromium than the sample deposited on 900B. Some other elements present in the base alloy such as silicon, niobium and manganese diffused into the coating but none amounted to more than 1 wt % on the welded layer. No heat treatment was given to these samples prior to their examination.

The samples were aged in air at 1150° C. for up to 500 hours. After each aging period the samples were taken out of the oven and dipped in water to assess the thermal shock resistance of the ensemble. None of the samples spalled or cracked after such treatments. The bulk microstructure did not drastically change after any aging time, as indicated in FIGS. 2 and 3. However, at the free surfaces and at the interface new structures developed. A 10 microns thick alumina layer was formed on the outer surface which proved to drastically reduce the formation of catalytic coke in coated HTA alloys. In voids and other inner defects, a core of mixed oxides (Cr—Al—Ni—Y0) was precipitated inside an alumina skin. The attack by oxygen extended several microns inside the coating. At the interface a large amount of nitrides, basically A1N, developed; these crystals grew in a dispersed manner as shown in FIGS. 4 and 5. The number of nitrides was larger in the sample prepared on the high chromium M46M alloy, probably due to a larger amount of nitrogen dissolved in the alloy. Even in this case, the nitrides did not agglomerate in a straight or continuous manner, hence reducing the possibility of a mechanical failure. This avoids the need for deposition of an interlayer whose main purpose was to absorb the nitrogen coming from the tube. The amount of aluminum in the bulk was reduced to just above five weight percent after 500 hours at aging at 1150° C., part of the original aluminum having diffused into the base alloy.

The method of the invention provides a number of important advantages. NiCrAlY powders are applied by plasma transferred arc to high temperature alloys and the resulting interface layer is dense, continuous and smooth and forms an adherent metallurgical bond with the HTA substrate. Any precipitated nitrides and carbides are dispersed in and in proximity to the interface layer, obviating the need for heat treatment of the coating or the provision of a separate interlayer. Enough aluminum is available in the coating to form an alumina surface scale. After 500 hours of aging in air at 1150° C. and thermal shock tests, the composition and bulk structure changed only slightly. Nitrides formed near the interface layer, however, these are dispersed and will not result in coating delamination. The surface region showed evidence of oxidation, however, the attack was shallow and sufficient aluminum remained to maintain the protective alumina scale. The surface alloy of the invention on HTAs has particular utility in the coating of reactor tubes for use in high temperature corrosive environments such as furnaces for the production of ethylene.

It will be understood, of course, that modifications can be made in the embodiments of the invention illustrated to described herein without departing from the scope and purview of the invention as defined by the appended claims.

We claim:

1. A method for providing a protective an inert coating on high temperature stainless steel comprising metallurgically bonding a continuous coating of a MCrAlX alloy, where M=nickel, cobalt or iron or mixture thereof and X=yttrium, hafnium, zirconium, lanthanum or combination thereof, having about 10 to 40 wt % chromium, about 3 to 30 wt % aluminum and up to about 5 wt % X, the balance M, by plasma transferred arc deposition of the coating onto a high temperature stainless steel substrate.

2. A method as claimed in claim 1, wherein said MCrAlX alloy has about 10 to 25 wt % chromium, 4 to 20 wt % aluminum and up to 3 wt % X.

3. A method as claimed in claim 1 in which the coating is deposited in a thickness of about 20 $\mu$m to 6000 $\mu$m onto the substrate.

4. A method as claimed in claim 3, in which the coating is deposited in a thickness of about 50 to 2000 $\mu$m.

5. A method as claimed in claim 3, in which the coating is deposited in a thickness of about 80 to 500 $\mu$M.

6. A method as claimed in claim 4 in which X is present in an amount of 0.25 to 1.5 wt %.

7. A method as claimed in 4 in which the MCrAlX is NiCrAlY and has, by weight, about 12 to 25% chromium, about 4 to 15% aluminum and about 0.5 to 1.5% yttrium, the balance nickel.

8. A method as claimed in claim 3 additionally comprising depositing a layer of aluminum having a thickness up to about 50% of the coating thickness on the coating and heat-treating the coating with aluminum thereon and the substrate to diffuse aluminum into the coating.

9. A method as claimed in claim 8, wherein a layer of aluminum having a thickness of up to about 20% of the coating thickness is deposited on the coating.

10. A surface alloyed component comprising a stainless steel base alloy substrate and a continuous coating deposited thereon by plasma transfer arc deposition of MCrAlX alloy in which fed is nickel, cobalt, iron or a mixture thereof and X=yttrium, hafnium, zirconium, lanthanum or combination thereof and comprising about 10 to 25 wt % chromium, about 4 to 20 wt % aluminum and up to about 3 wt % X, the balance M, wherein the MCrAlX alloy coating has a thickness of about 80 to 500 $\mu$m, and an aluminum surface layer having a thickness up to about 50% of the coating thickness metallurgically bonded to the coating.

11. A surface alloyed component as claimed in claim 10, in which X is present in an amount of 0.25 to 1.5 wt %.

12. A surface alloyed component as claimed in claim 11 in which the MCrAlX is NiCrAlY comprising, by weigh, about 12 to 25% chromium, about 4 to 15% aluminum, about 0.5 to 1.5 wt % yttrium, and the balance substantial nickel.

13. A surface alloyed component as claimed in claim 10 in which the aluminum surface layer has a thickness of about 20% of the coating thickness and a protective alumina scale thereon.

14. A coking and corrosion resistant reactor tube for use in high temperature environments comprising an elongated tube formed from a high temperature stainless steel and a continuous coating metallurgically bonded on an inner surface of the elongated tube comprising a MCrAlX alloy wherein M is Ni, Co, Fe or a mixture thereof and X is yttrium, hafnium, zirconium, lanthanum or combination thereof and comprising, by weight, about 10 to 25% chromium, about 4 to 20% aluminum and up to about 3% yttrium, hafnium, zirconium or lanthanum by plasma transferred arc deposition of the coating onto the inner surface of the elongated tube, and wherein the MCrAlX coating has a thickness of about 20 to 6000 $\mu$m and is metallurgically bonded to the stainless steel substrate.

15. A coking and corrosion resistant reactor tube as claimed in claim 14 additionally comprising an aluminum surface layer having thickness of up to 20% of the coating thickness metallurgically bonded to the coating and having an aluminum scale thereon.

16. A coking and corrosion resistant reactor tube produced by the method of claim 3.

17. A coking and corrosion resistant reactor tube produced by the method of claim 7.

18. A coking and corrosion resistant reactor tube produced by the method of claim 9.

19. A furnace for the production of ethyl including a plurality of reactor tubes each comprising an elongated tube formed from a high temperature stainless steel and a continuous coating of a MCrAlX alloy wherein M is Ni, Co, Fe or a mixture thereof and X is yttrium, hafnium, zirconium, lanthanum or combination thereof and comprising, by weight, about 10 to 40% chromium, about 3 to 30% aluminum and up to 5% yttrium, hafnium, zirconium and/or lanthanum, the balance M, deposited in a thickness of about 20 to 6000 $\mu$m and metallurgically bonded to the inner surface of the elongated tube by plasma transfer arc deposition.

20. A furnace as claimed in claim 19 in which each reactor tube additionally comprises an aluminum layer having a thickness of about 20% of the coating thickness metallurgically bonded to the coating and having an alumina scale thereon.

21. A furnace as claimed in claim 19 in which the MCrAlX is NiCrAlY having, by weight, about 10 to 25% chromium, about 4 to 20% aluminum and about 0.5 to 1.5% yttrium, the balance nickel.

* * * * *